US010480527B2

(12) United States Patent
Van Houten et al.

(10) Patent No.: US 10,480,527 B2
(45) Date of Patent: Nov. 19, 2019

(54) AXIAL FAN WITH UNBALANCED BLADE SPACING

(71) Applicant: Robert Bosch GmbH, Stuttgart (DE)

(72) Inventors: Robert J. Van Houten, Winchester, MA (US); Yoonshik Shin, Chandler, AZ (US)

(73) Assignee: Robert Bosch GmbH, Stuttgart (DE)

( * ) Notice: Subject to any disclaimer, the term of this patent is extended or adjusted under 35 U.S.C. 154(b) by 273 days.

(21) Appl. No.: 15/588,205

(22) Filed: May 5, 2017

(65) Prior Publication Data

US 2018/0320705 A1 Nov. 8, 2018

(51) Int. Cl.

| | |
|---|---|
| ***F04D 29/66*** | (2006.01) |
| ***F04D 29/38*** | (2006.01) |
| ***F04D 19/00*** | (2006.01) |
| ***F04D 29/32*** | (2006.01) |
| ***F01P 5/02*** | (2006.01) |
| *F04D 29/26* | (2006.01) |

(52) U.S. Cl.

CPC ..... *F04D 29/388* (2013.01); *F01P 5/02* (2013.01); *F04D 19/002* (2013.01); *F04D 29/325* (2013.01); *F04D 29/327* (2013.01); *F04D 29/328* (2013.01); *F04D 29/384* (2013.01); *F04D 29/662* (2013.01); *F04D 29/666* (2013.01); *F04D 29/263* (2013.01); *F04D 29/38* (2013.01); *F05B 2240/301* (2013.01); *F05B 2260/20* (2013.01); *F05D 2260/961* (2013.01)

(58) Field of Classification Search

CPC .... F04D 29/327; F04D 29/328; F04D 29/388; F04D 29/662; F04D 29/666; F05D 2260/961

See application file for complete search history.

(56) References Cited

U.S. PATENT DOCUMENTS

| | | | | |
|---|---|---|---|---|
| 1,983,606 | A * | 12/1934 | Geise | F04D 29/666 123/41.49 |
| 2,097,389 | A * | 10/1937 | De Mey | F04D 29/384 416/243 |
| 2,098,640 | A * | 11/1937 | Cary | F04D 29/666 415/119 |
| 3,711,219 | A | 1/1973 | Strick | |
| 5,399,070 | A * | 3/1995 | Alizaden | F04D 29/329 416/189 |
| 5,681,145 | A | 10/1997 | Neely et al. | |

(Continued)

FOREIGN PATENT DOCUMENTS

| | | | |
|---|---|---|---|
| DE | 946178 | C | 7/1956 |
| DE | 2524555 | A1 | 12/1975 |
| WO | 9949223 | A1 | 9/1999 |

OTHER PUBLICATIONS

International Search Report for Application No. PCT/EP2018/060622 dated Aug. 6, 2018 (4 pages).

*Primary Examiner* — Ninh H. Nguyen

(74) *Attorney, Agent, or Firm* — Michael Best & Friedrich LLP

(57) ABSTRACT

An axial fan comprising a hub and a plurality of blades extending from a periphery of the hub. Each of the blades has a thickness which varies from a leading edge to a trailing edge and from a root to a tip. The blades are unevenly spaced around the periphery of the hub in a pattern which is not balanced. The fan is balanced by variance in blade thickness among the plurality of blades.

17 Claims, 18 Drawing Sheets

(56) References Cited

U.S. PATENT DOCUMENTS

| | | | | |
|---|---|---|---|---|
| 6,065,937 | A | 5/2000 | Hunt | |
| 6,471,482 | B2 | 10/2002 | Montgomery et al. | |
| 6,491,499 | B1 | 12/2002 | Marvin et al. | |
| 6,554,574 | B1 | 4/2003 | Spaggiari | |
| 6,719,530 | B2 * | 4/2004 | Chow | F04D 29/328 416/203 |
| 7,568,885 | B2 | 8/2009 | Parker et al. | |
| 8,656,589 | B2 | 2/2014 | Kurt-Elli | |
| 9,097,125 | B2 | 8/2015 | Zarimahalleh et al. | |
| 9,435,349 | B2 | 9/2016 | Qian et al. | |
| 2002/0125215 | A1 * | 9/2002 | Davis | B23P 6/002 216/100 |
| 2008/0101936 | A1 | 5/2008 | Lee et al. | |
| 2010/0326377 | A1 | 12/2010 | Nam et al. | |

* cited by examiner

AXIAL FAN WITH UNBALANCED BLADE SPACING

BACKGROUND

This invention relates generally to axial-flow fans, which may be used as automotive engine-cooling fans, among other uses.

Engine-cooling fans are used in automotive vehicles to move air through a set of heat exchangers which typically includes a radiator to cool an internal combustion engine, an air-conditioner condenser, and perhaps additional heat exchangers. These fans are generally positioned in a shroud which directs air between the heat exchangers and the fan and controls recirculation. Typically, these fans are powered by an electric motor which is supported by a plurality of arms which extend from a motor mount to the shroud.

The aerodynamic noise generated by these fans includes both broadband noise and acoustic tones. These tones are caused by time-varying forces on the blades, which are the response of the blades to upstream and downstream flow disturbances. The upstream disturbances are typically due to the non-axisymmetric nature of the shroud and heat exchangers, and the downstream disturbances are due to the motor-support arms and any other object which is close to the fan blades.

The spectrum of the noise generated by each blade in response to these flow disturbances consists of many harmonics of the shaft rotation rate. If the blades are evenly spaced, the spectrum of the noise generated by the entire fan consists only of harmonics of the blade rate—the product of the blade number and the shaft rate. Destructive interference cancels the harmonics between the blade rate harmonics, and constructive interference enhances the tones at the blade rate harmonics. These tones can be subjectively very annoying, and the designer often modifies the fan geometry to minimize this annoyance.

One way the designer can improve the subjective noise quality is to space the fan blades unevenly. In order to maintain good fan performance, the extent of the unevenness must be limited. But even with a modest amount of unevenness, the higher-order blade-rate harmonics of the fan spectrum can be significantly reduced. As the blade rate harmonics in the fan spectrum are reduced, the other shaft harmonics, which in the case of the evenly-spaced fan are non-existent, are increased. In other words, both the constructive and destructive tone cancellation is reduced if the blades are unevenly spaced. The result can be a fan with a noise characteristic which is subjectively less annoying than that of an evenly-spaced fan.

Because each blade of an unevenly-spaced fan sees a somewhat different inflow, and is required to develop a somewhat different amount of lift, the pitch and camber, and perhaps even the chord, of each blade might ideally be adjusted according to its position relative to the other blades. However, for reasonable amounts of unevenness, it is often possible to use blades with identical geometries. In fact, it is often observed that an evenly-spaced fan has the same performance as an unevenly-spaced fan which uses the same blade geometry.

One constraint on the design of a fan with unevenly-spaced blades is that the fan be balanced. Any imbalance in the fan can cause unsteady forces on the fan assembly which cause significant shaft-rate noise and vibration. Although a small amount of imbalance can be corrected by the addition or subtraction of weight (clips or balance balls) at particular locations, this is not practical when correcting a large amount of imbalance, such as that caused by improper blade spacing. Therefore, when calculating the desired position of fan blades, two of those blade positions must in general be determined by the balance requirement—one for balance around each of the transverse axes. If the blades are of identical design, such a strategy also guarantees that no couple imbalance will be caused by the uneven blade spacing.

Although a wide variety of blade spacing arrangements which assure balance is available to the designer of a fan with many blades, the designer of a fan with fewer blades has less choice. In particular, the spacing of the blades of a 4-blade fan has only one inter-blade spacing that can be selected arbitrarily. Once that space is selected, all other inter-blade spacings are determined by the balance requirement. A 3-blade fan is even more problematic, in that no unevenly-spaced blade arrangement is available that assures balance.

One solution to this problem is to always use at least 5 blades on a fan where some flexibility in blade spacing is desired. However, there are often aerodynamic advantages to the use of fewer blades. In particular, a lightly-loaded fan requires less blade solidity, and often benefits from using fewer blades rather than more blades with reduced blade area. A free-tip fan, in particular, benefits from the use of a small number of blades, since vortex-interaction noise is minimized by maximizing the distance between the fan blades.

There is therefore a need for fans which have the aerodynamic and noise advantages of small blade number, but the subjective noise advantage of uneven blade spacing.

SUMMARY

In one aspect, the present invention provides an axial fan comprising a hub and a plurality of blades extending from a periphery of the hub. Each of the blades has a thickness which varies from a leading edge to a trailing edge and from a root to a tip. The blades are unevenly spaced around the periphery of the hub in a pattern which is not balanced. The fan is balanced by variance in blade thickness among the plurality of blades.

In another aspect of the invention, the blade thickness of a first blade is scaled by individual blade thickness factors to define the thickness of each of the other blades, said blade thickness factors varying among the plurality of blades in such a way that the fan is balanced.

In another aspect of the invention, a ratio defined as the thickness factor of a thickest one of the plurality of blades divided by the thickness factor of a thinnest one of the plurality of blades is at least 1.05.

In another aspect of the invention, a ratio defined as the thickness factor of a thickest one of the plurality of blades divided by the thickness factor of a thinnest one of the plurality of blades is at least 1.10.

In another aspect of the invention, the blade thickness factors of all of the plurality of blades are unique.

In another aspect of the invention, the blade thickness factors of all but two of the plurality of blades are unique.

In another aspect of the invention, the plurality of blades consists of exactly three blades.

In another aspect of the invention, the plurality of blades consists of exactly four blades.

In another aspect of the invention, a mean surface defined by each of the plurality of blades is identical.

In another aspect of the invention, the axial fan is a free-tipped axial fan.

In another aspect of the invention, the axial fan is an automotive engine-cooling fan.

In another aspect of the invention, the spacing of the plurality of blades is symmetric about a line of symmetry.

In another aspect of the invention, the spacing of the plurality of blades is symmetric about a line of symmetry and two of the plurality of blades whose positions are symmetric relative to the line of symmetry have equal thickness.

In another aspect of the invention, a ratio defined as a largest spacing angle between adjacent ones of the plurality of blades divided by a smallest spacing angle between adjacent ones of the plurality of blades is at least 1.15.

In another aspect of the invention, the ratio defined as the largest spacing angle between adjacent ones of the plurality of blades divided by the smallest spacing angle between adjacent ones of the plurality of blades is at least 1.20.

In another aspect of the invention, the ratio defined as the largest spacing angle between adjacent ones of the plurality of blades divided by the smallest spacing angle between adjacent ones of the plurality of blades is less than or equal to 1.80

In another aspect of the invention, the ratio defined as the largest spacing angle between adjacent ones of the plurality of blades divided by the smallest spacing angle between adjacent ones of the plurality of blades is less than or equal to 1.60.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
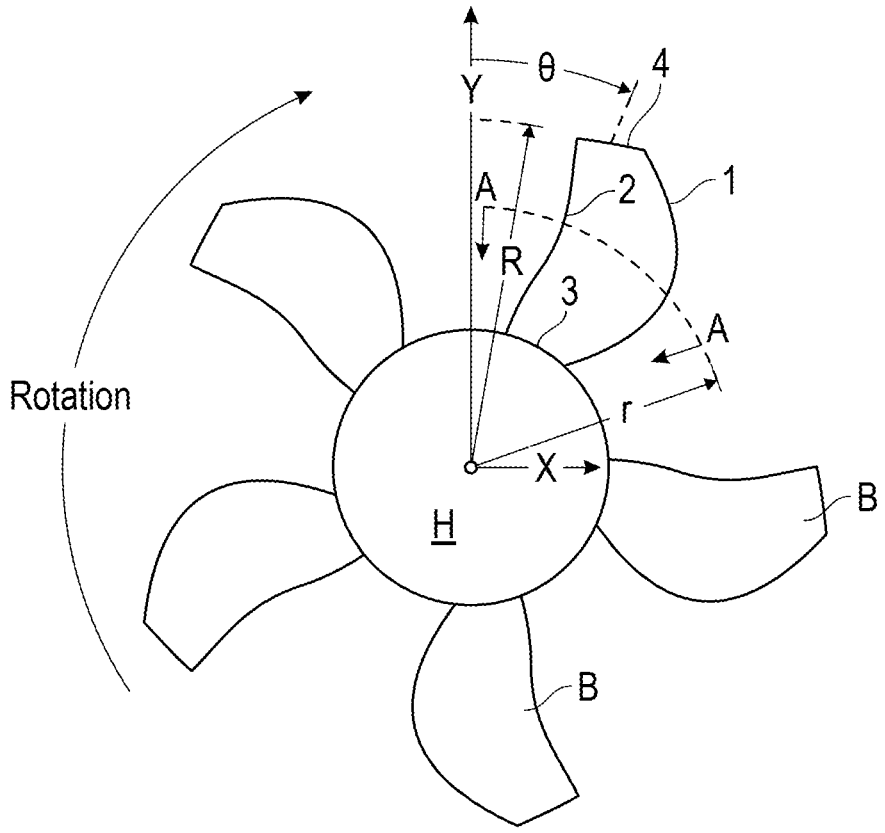
FIG. 1*a* is a schematic view of a fan, with some definitions of terms.
Figure 1B:
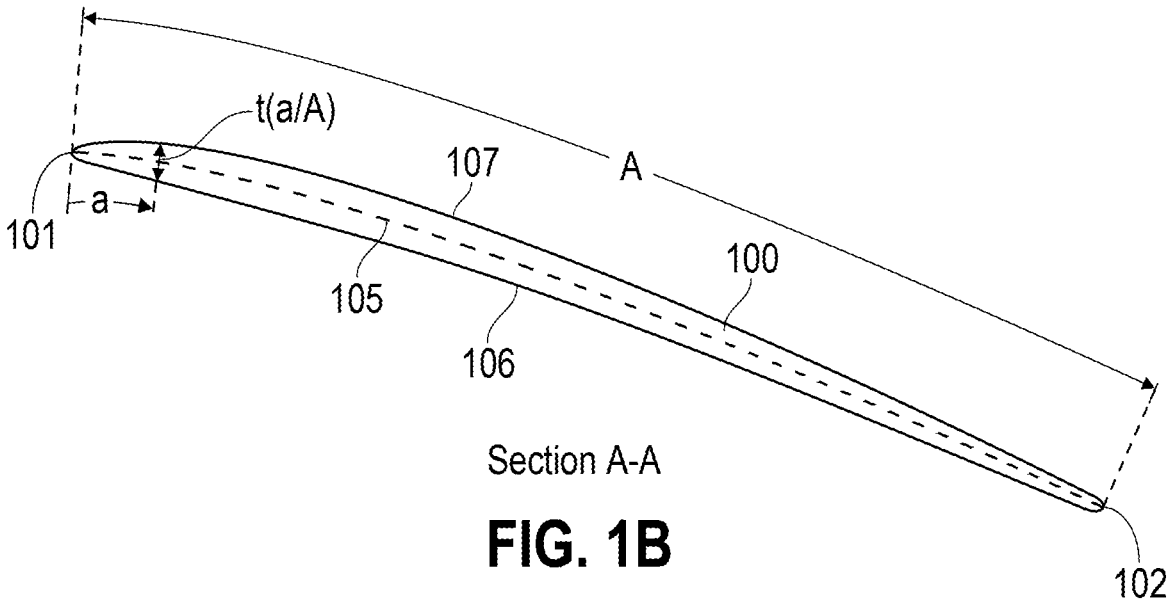
FIG. 1*b* is a representative cylindrical section through the fan of FIG. 1*a*, with definitions of some sectional properties.

FIGS. 1*a* and 1*b* are used to define basic terms as used throughout the remainder of the description and drawings, with reference to each fan disclosed herein. FIG. 1*a* is a schematic view of a fan having a plurality of blades B extending from a peripheral surface of a hub H. The fan radius "R" is defined as the radius of the trailing edge of the blade tip. Shown are the leading edge 1, the trailing edge 2, the blade root 3 and the blade tip 4. A circumferential section A-A is indicated at radius "r".

FIG. 1*b* is a view of the circumferential section A-A in FIG. 1*a*. The blade section 100 has a leading edge 101 and a trailing edge 102. A mean line 105 of the blade is defined as the line that lies midway between opposed "lower" and "upper" surfaces 106, 107. More precisely, the distance from a point on the mean line 105 to the upper surface 107, measured normal to the mean line 105, is equal to the distance from that point on the mean line 105 to the lower surface 106, measured normal to the mean line 105. The meanline arclength is defined as "A". The blade thickness "t" at any position "a" along the mean line 105 is the distance between the upper surface 107 and the lower surface 106, measured normal to the mean line at that position. The thickness can be specified as a function of position along the mean line a/A as well as the radial location r/R.

The mean surface of the blade is defined as the surface whose circumferential section at any radius is identical to the mean line at that radius, as defined above.

The angular position of a blade "θ" is defined as the angular position of a representative point on the blade relative to an arbitrary fixed angular position, and the angular spacing "δ" between two adjacent blades is defined as the angular distance between representative points on those two blades. In FIG. 1*a* and in other figures in this document, the representative point is assumed to be halfway between the leading edge and the trailing edge of the blade at a radial position equal to the fan radius R. However, any other representative point can be chosen, as long as the same representative point is assumed for every blade. Similarly, in FIG. 1*a* and in other figures in this document, the arbitrary fixed angular position is the position of the y axis, although any other arbitrary fixed angular position can be used.

Figure 2A:
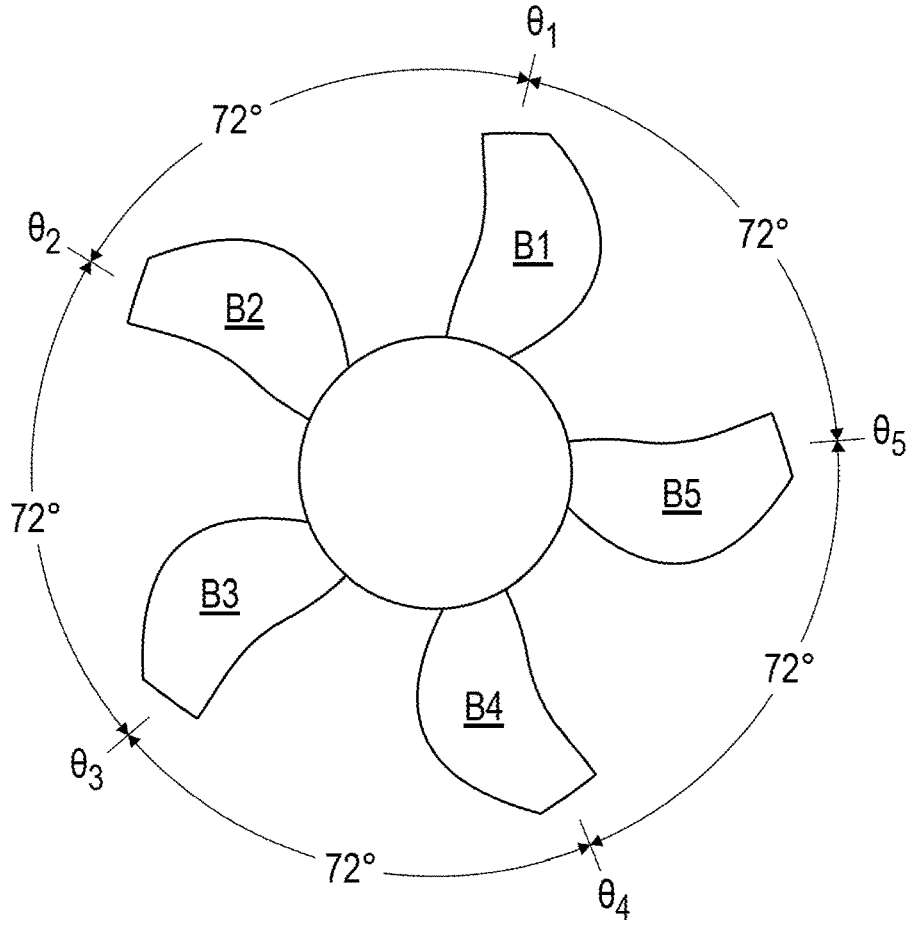
FIG. 2A (Prior Art)
FIG. 2*a* is a schematic view of a prior-art evenly-spaced 5-blade fan.

FIG. 2*a* shows a prior-art 5-blade fan with evenly-spaced blades B1 to B5. The angular position of each blade tip is shown as $\theta_i$, where "i" is the index of the blade. The angular spacing between adjacent blades is a constant 72 degrees.

Figure 2B:
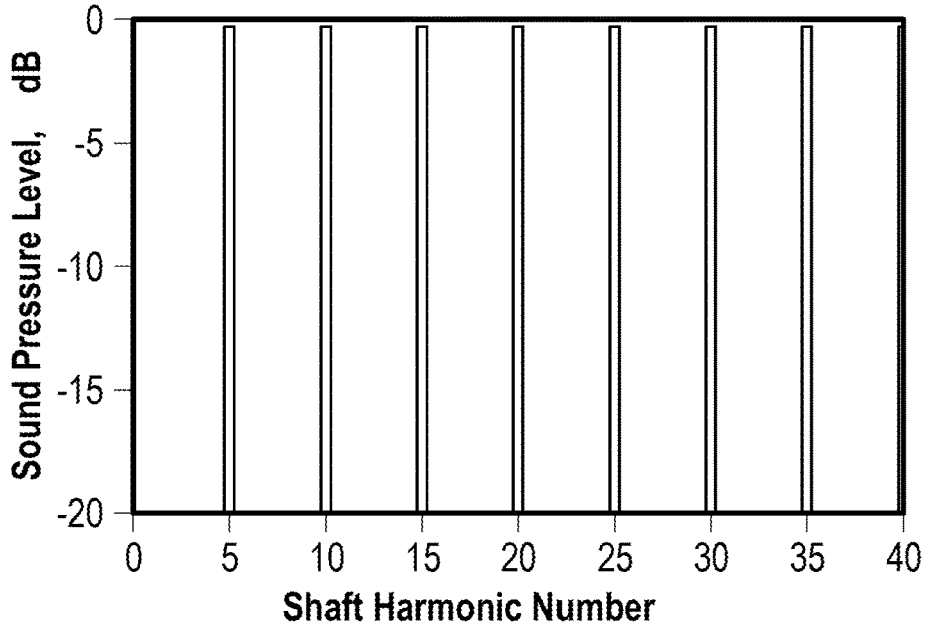
FIG. 2*b* is a schematic of the tone spectrum of the fan of FIG. 2*a*.
Figure 2C:
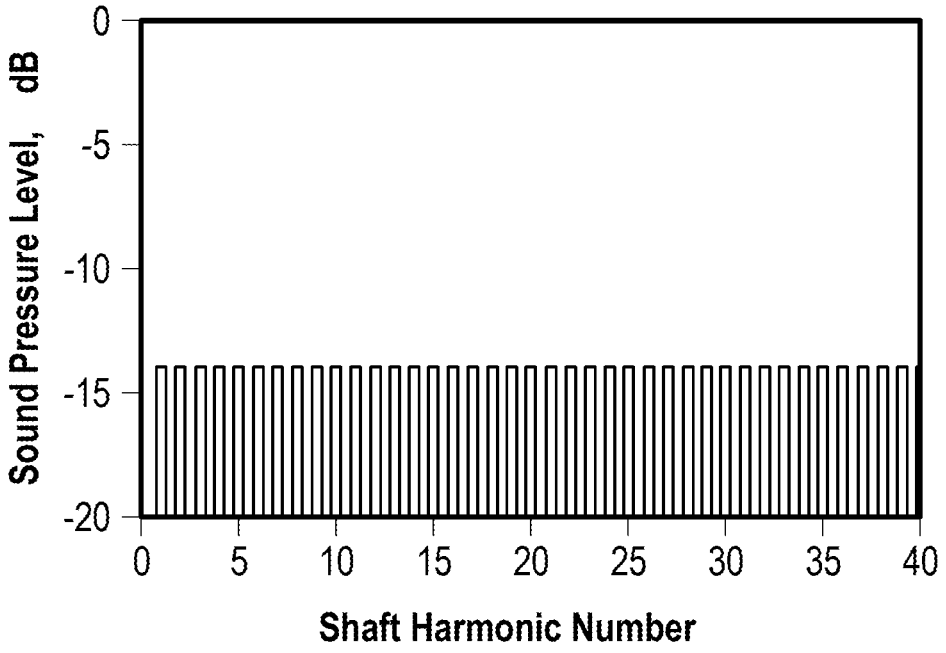
FIG. 2*c* is a schematic of the assumed single-blade tone spectrum that results in the fan tone spectrum of FIG. 2*b*.

FIG. 2*c* shows a "bar graph" schematic of an assumed spectrum of acoustic tones generated by a single blade of the fan of FIG. 2*a* as it rotates. This is a theoretical spectrum in that one will not hear the noise corresponding to this spectrum because the other blades are also generating tones. In the single-blade spectrum shown in FIG. 2*c* all shaft harmonic orders have the same magnitude. This corresponds to a sound pressure which is an impulse in the time domain. The actual single-blade spectrum will depend on the details of the fan's operating environment. It is in general unknown, and can only be inferred from experiments. But by assuming an impulsive spectrum, one can select a blade spacing which is effective in a variety of operating environments.

FIG. 2*b* shows the tonal noise spectrum of the entire fan of FIG. 2*a*, based on the assumed impulsive single-blade spectrum of FIG. 2*c*. The tones at shaft-rate orders equal to multiples of the blade number 5 are increased by 20 log 5=14 dB due to constructive interference, while all other shaft-rate harmonics are non-existent due to destructive interference. The single-blade shaft-rate harmonic tones are assumed to be at a level of −14 dB, to result in blade-rate orders in the fan spectrum at a level of 0 dB.

Figure 3A:
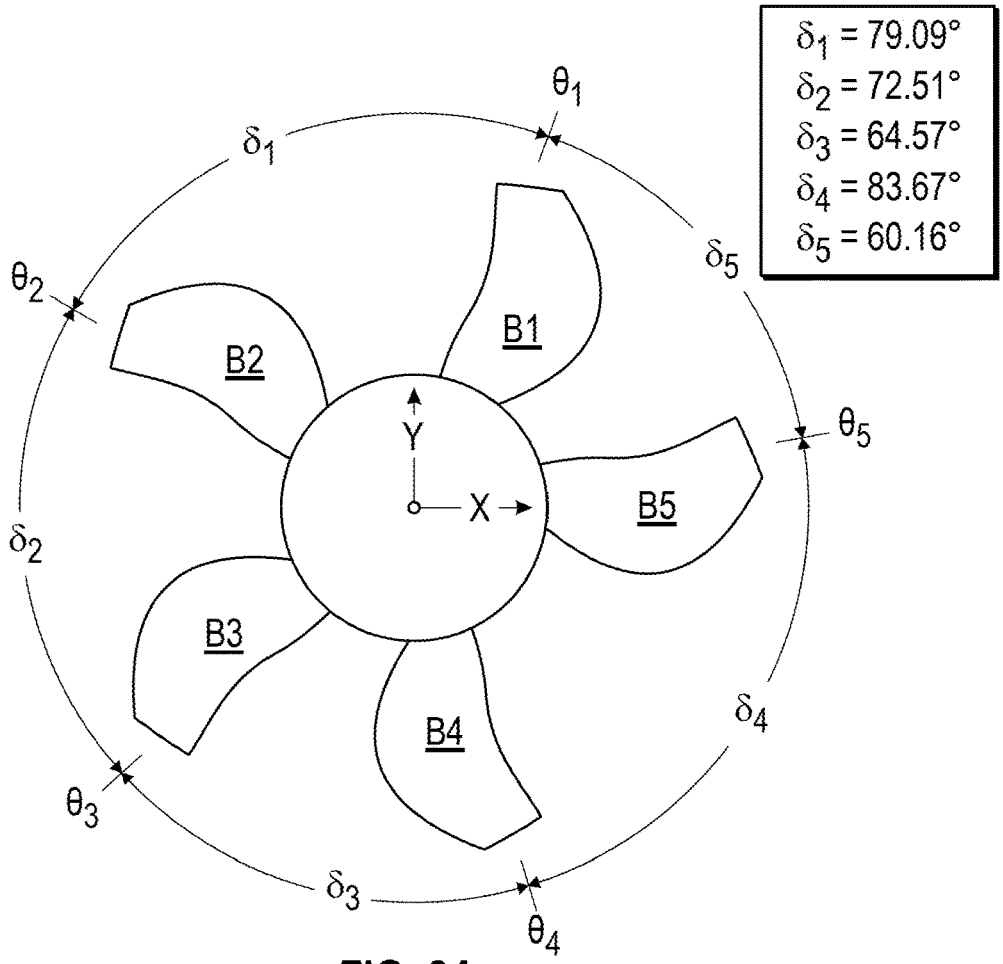
FIG. 3A (Prior Art)
FIG. 3*a* is a schematic view of a prior-art unevenly-spaced 5-blade fan.

FIG. 3*a* shows a prior-art fan with unevenly-spaced blades, each of which has identical geometry. This fan has perfect balance, since the blade spacing was selected to assure that the following relations were maintained:

$$\sum_{i=1}^{Z} \sin\theta_i = 0$$

$$\sum_{i=1}^{Z} \cos\theta_i = 0$$

Where $\theta_i$ is the angular position of the $i^{th}$ blade, and Z is the total number of blades, which for the fan of FIG. 3*a* is 5. These two equations state that the blades are balanced about the y and x axes, respectively. Any spacing of blades satisfying these two equations can be called a balanced spacing or a balanced pattern.

Although FIG. 3*a* shows just one set of blade position angles, other balanced arrangements of five identical blades are also possible. One blade position angle merely fixes the rotation angle of the fan. Two blade angles can be arbitrarily specified, and the remaining two blade angles are dictated by the balance requirement.

Figure 3B:
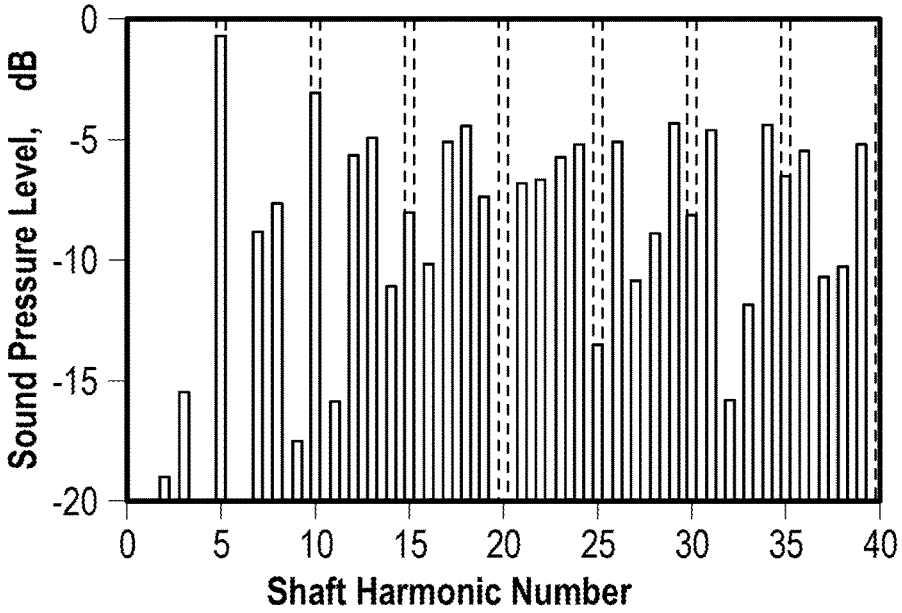
FIG. 3*b* is a schematic of the tone spectrum of the fan of FIG. 3*a*.

FIG. 3*b* shows a schematic of the tone spectrum of the fan of FIG. 3*a*, assuming that the single-blade spectrum is the same for all blades, and equal to that shown in FIG. 2*c*. For comparison, the spectrum of the evenly-spaced fan (FIG. 2*b*) is shown as dotted bars. The spectrum of the fan with uneven blade spacing has reduced tones at the harmonics of blade rate, and observable tones at harmonics of shaft rate which are not harmonics of blade rate. The tone at the first blade-rate harmonic is only slightly reduced, but the higher blade-rate harmonic tones are reduced significantly. Subjectively, most observers would consider the noise of the unevenly-spaced fan to be less annoying than that of the evenly-spaced fan.

Figure 4A:
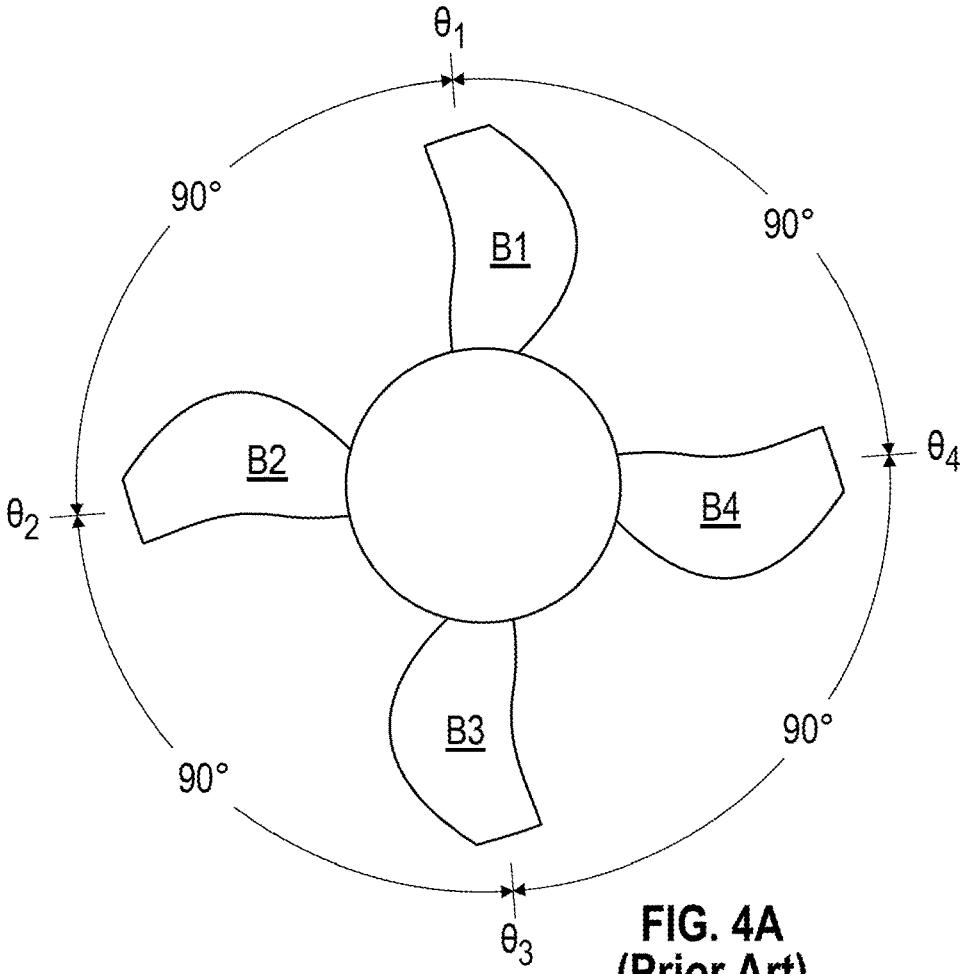
FIG. 4A (Prior Art)
FIG. 4*a* is a schematic view of a prior-art evenly-spaced 4-blade fan.
Figure 4B:
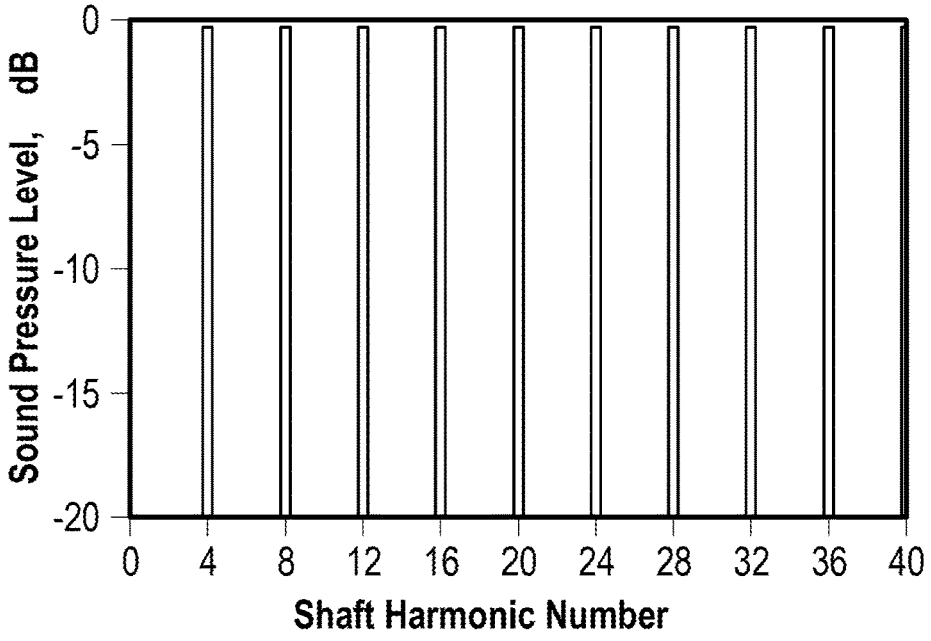
FIG. 4*b* is a schematic of the tone spectrum of the fan of FIG. 4*a*.
Figure 4C:
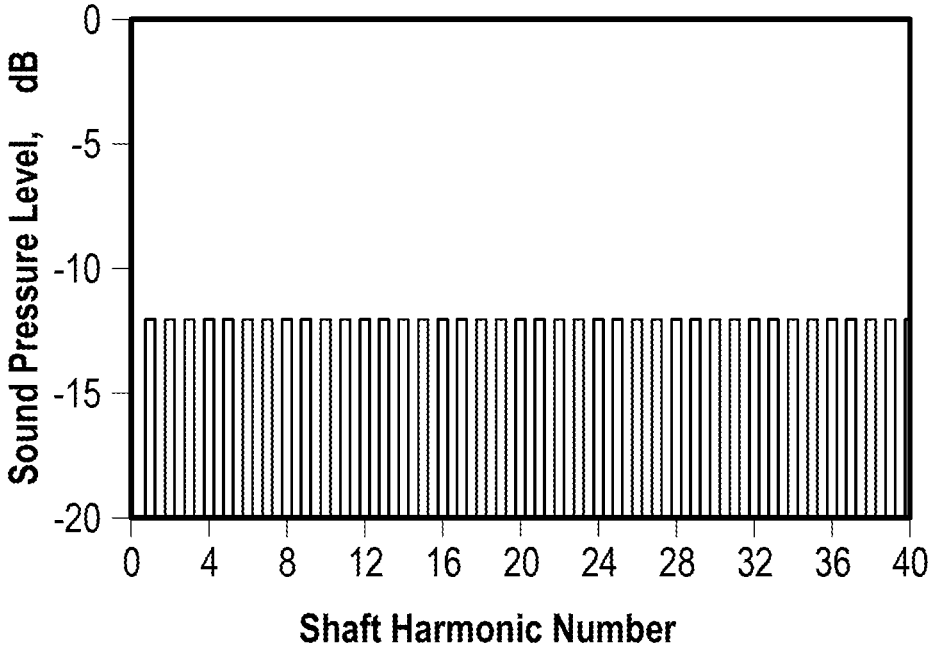
FIG. 4*c* is a schematic of the assumed single-blade tone spectrum that results in the fan tone spectrum of FIG. 4*b*.

FIG. 4*a* shows a prior-art 4-blade fan with evenly-spaced blades B1 to B4. The angular spacing between adjacent blades is a constant 90 degrees. FIG. 4*c* shows an impulsive single-blade spectrum which results in the fan spectrum of FIG. 4*b*. As in the case of a 5-blade evenly-spaced fan, strong tones are at those shaft-rate harmonics which are harmonics of the blade rate, and there are no tones at other shaft-rate harmonics. The impulsive spectrum of FIG. 4*c* has been scaled so that the blade-rate tones of the fan spectrum have a magnitude of 0 dB.

Figure 5A:
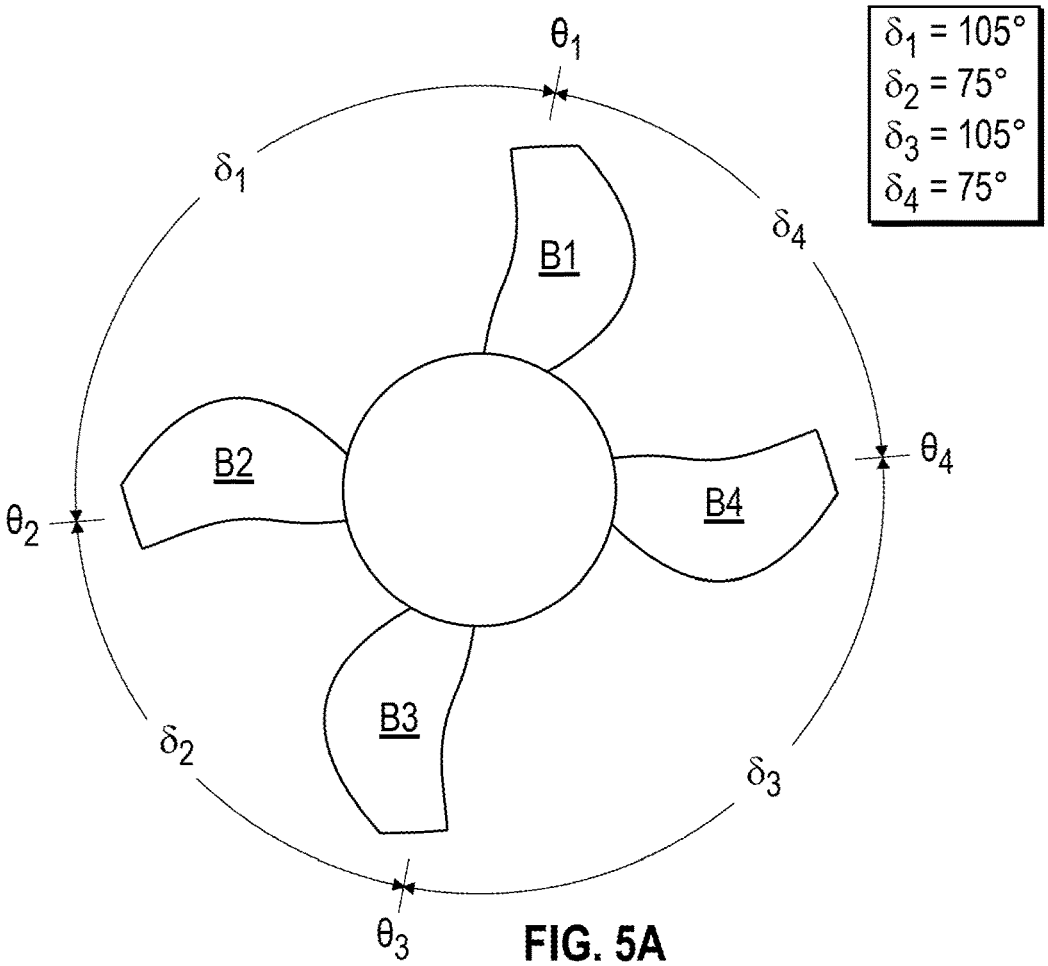
FIG. 5A (Prior Art)
FIG. 5*a* is a schematic view of a prior-art unevenly-spaced 4-blade fan.

FIG. 5*a* shows a prior-art 4-blade fan with unevenly-spaced blades B1 to B4, each of which has identical geometry. This fan is perfectly balanced. Other balanced arrangements of four identical blades are also possible. In the case of a 4-blade fan, the angular position of two adjacent blades can be chosen arbitrarily, and the two remaining blade angles are dictated by the balance requirement. One of the arbitrary angles merely fixes the rotation angle of the fan, so that there is only one degree of freedom in the selection of a balanced pattern of blades. Every balanced pattern of four identical blades features two sets of diametrically-opposed blades.

Figure 5B:
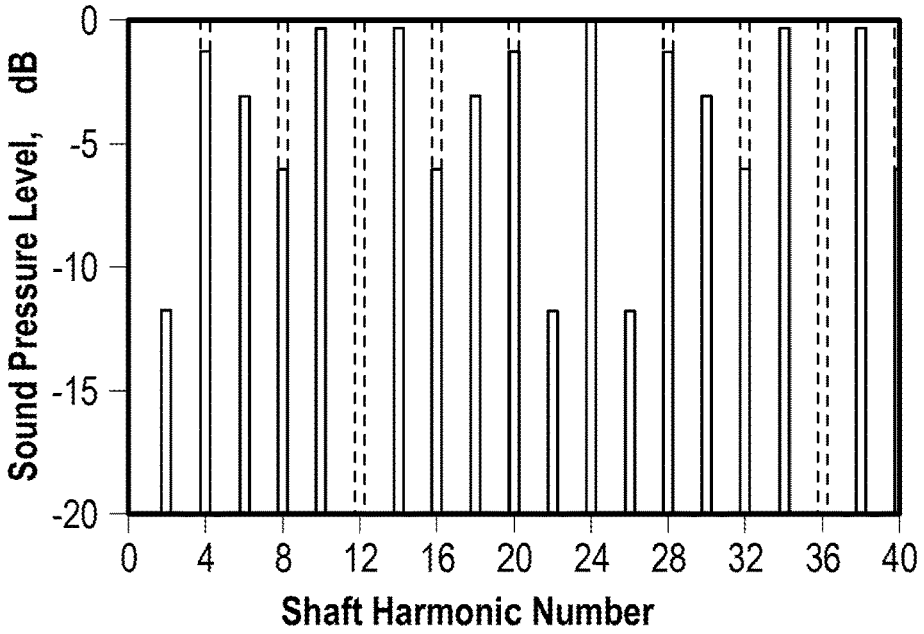
FIG. 5*b* is a schematic of the tone spectrum of the fan of FIG. 5*a*.

FIG. 5*b* shows a schematic of the tone spectrum of the fan shown in FIG. 5*a*, assuming that the single-blade spectrum is the same for all blades, and equal to that shown in FIG. 4*c*. For comparison, the spectrum of the evenly-spaced fan (FIG. 4*b*) is shown as dotted bars. Because the blade spacing of the fan shown in FIG. 5*a* comprises two identical groups of blades, evenly spaced circumferentially, the fan spectrum has non-zero tones only at even shaft-harmonic numbers, and zero tones at odd shaft-harmonic numbers. This reduces the extent to which the tonal energy is spread to different harmonics, and reduces the benefits of uneven blade spacing.

Figure 6A:
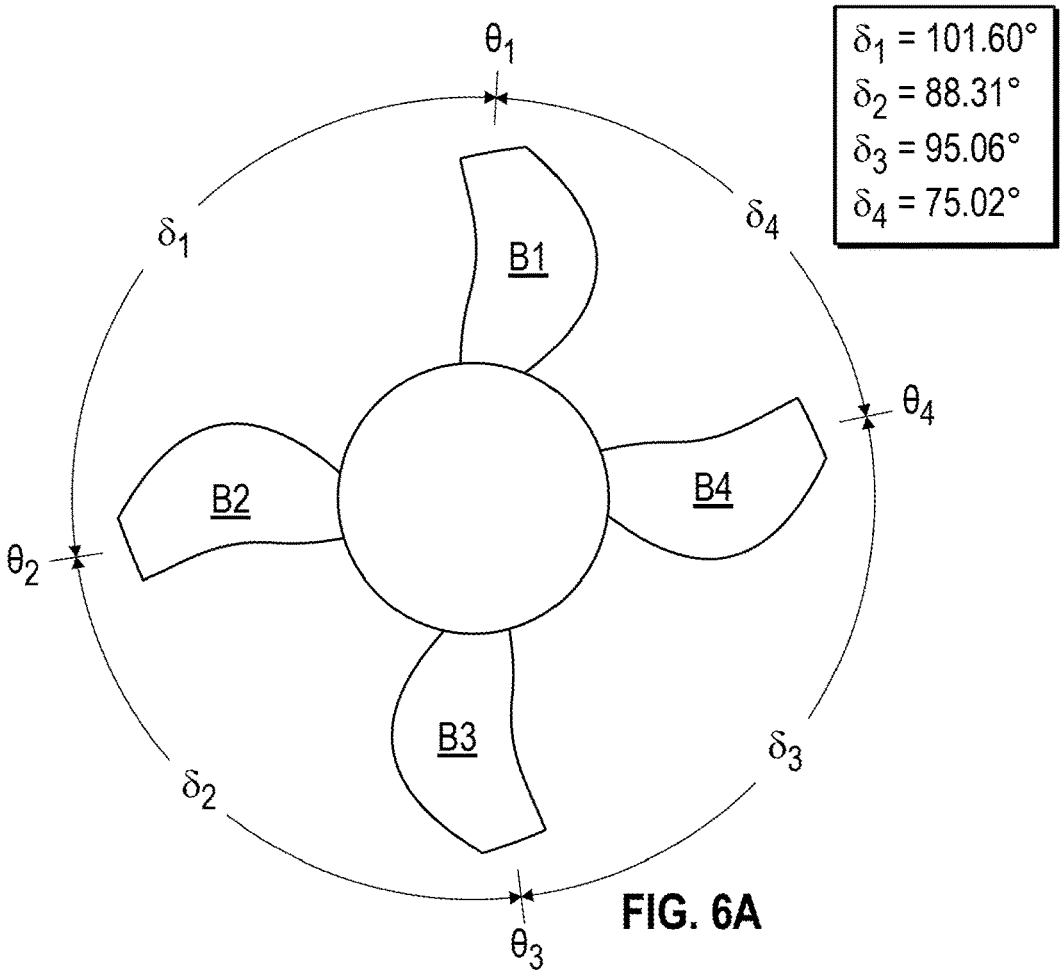
FIG. 6*a* is a schematic view of an unevenly-spaced 4-blade fan according to the present invention.

FIG. 6*a* shows an unevenly-spaced 4-blade fan according to the present invention. The blades B1 to B4 of this fan, which are spaced to achieve the desired tonal properties, have identical geometry except for the blade thickness, which differs for each blade by a constant factor. The thickness of a fan blade in the case of a fan with equal spacing (FIG. 4*a*) or a balanced spacing (FIG. 5*a*) can be considered to be the "design thickness". This thickness $t_d$ (a/A, r/R) varies from the leading edge 1 to the trailing edge 2, and from the root 3 to the tip 4. The thickness at every position on the $i^{th}$ blade of the fan in FIG. 6*a* will be equal to the design thickness at the corresponding position, multiplied by the thickness factor $T_i$, which is constant for any blade, but will differ between blades.

$$t_i\left(\frac{a}{A}, \frac{r}{R}\right) = T_i t_d\left(\frac{a}{A}, \frac{r}{R}\right)$$

The values of $T_i$ which will result in a balanced fan are given by the solution of the following equations:

$$\sum_{i=1}^{z} T_i \sin\theta_i = 0$$

$$\sum_{i=1}^{z} T_i \cos\theta_i = 0$$

These equations are homogeneous, and any solution set of values of $T_i$ can be multiplied by a constant factor to obtain another solution set. We can therefore arbitrarily set the value of $T_1$ to be equal to 1.0. We then have Z−1 unknown values of $T_i$ and two equations to satisfy.

In the case of a 4-blade fan, one value of $T_i$ (in addition to $T_1$, which is identically equal to 1.0) can be arbitrarily chosen, and the remaining two values determined by satisfying the two balance equations. In order to minimize any problems which may result from having blades of varying thickness, the arbitrary thickness factor can be selected to minimize the ratio defined as the thickness factor $T_{max}$ of a thickest one of the plurality of blades divided by the thickness factor $T_{min}$ of a thinnest one of the plurality of blades. For the fan shown in FIG. 6*a*, FIG. 6*c* shows a plot of the variation in that ratio with assumed values of $T_2$, assuming that $T_1$ remains equal to 1.0. As shown in FIG. 6*c*, the ratio of the maximum blade thickness factor to the minimum blade thickness factor has a minimum value between 1.15 and 1.20, and more particularly 1.169.

Although the balance of the fan is assured by satisfying the above set of equations, structural, manufacturing, and cost issues may dictate the minimum and/or the maximum blade thickness. In that case the entire set of Ti values can be multiplied by a constant factor before being applied as individual thickness factors.

Figure 6B:
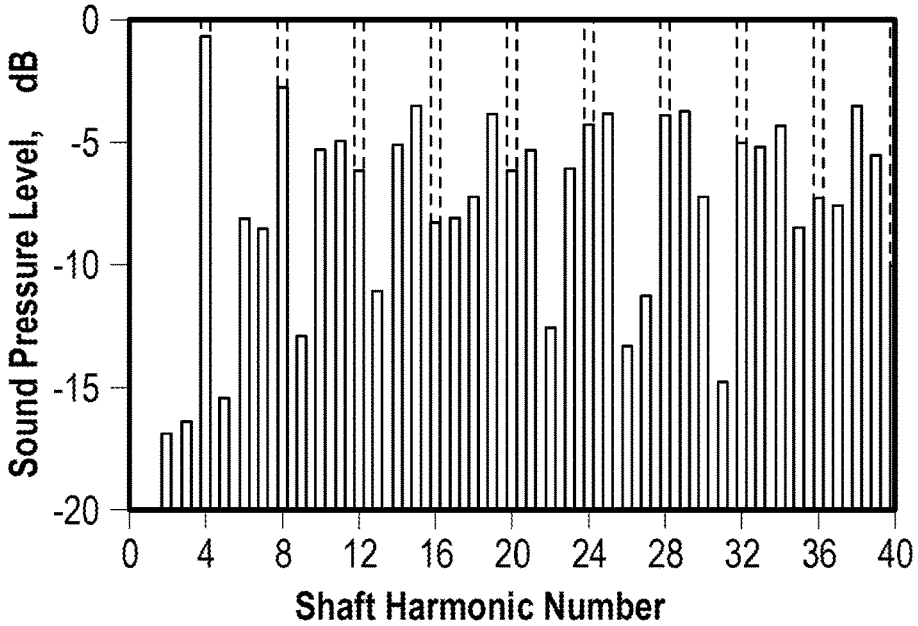
FIG. 6*b* is a schematic of the tone spectrum of the fan of FIG. 6*a*.
Figure 6C:
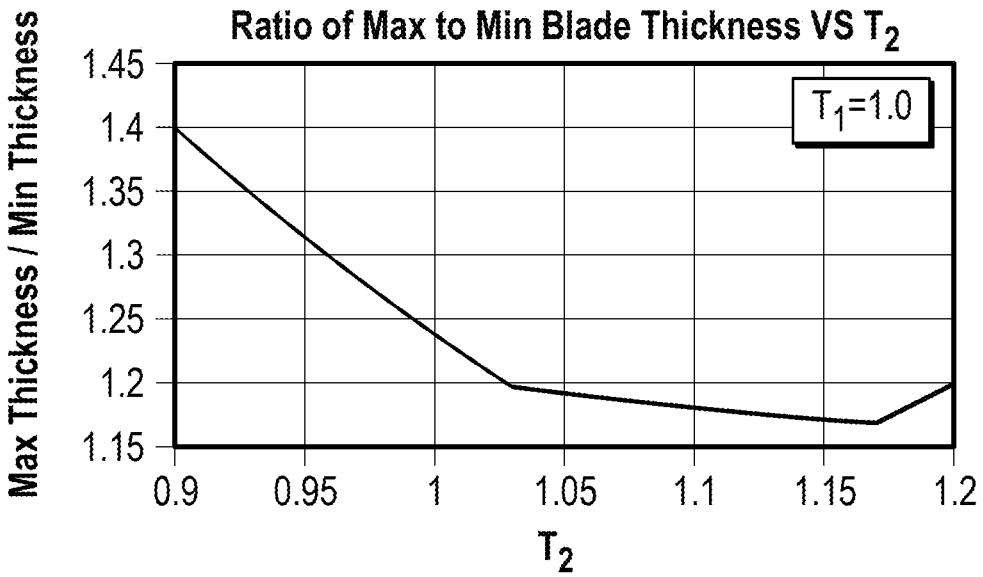
FIG. 6*c* is a graph showing how the ratio of maximum blade thickness factor to minimum blade thickness factor varies with the thickness factor chosen for blade number 2 of the fan of FIG. 6*a*.
Figure 6D:
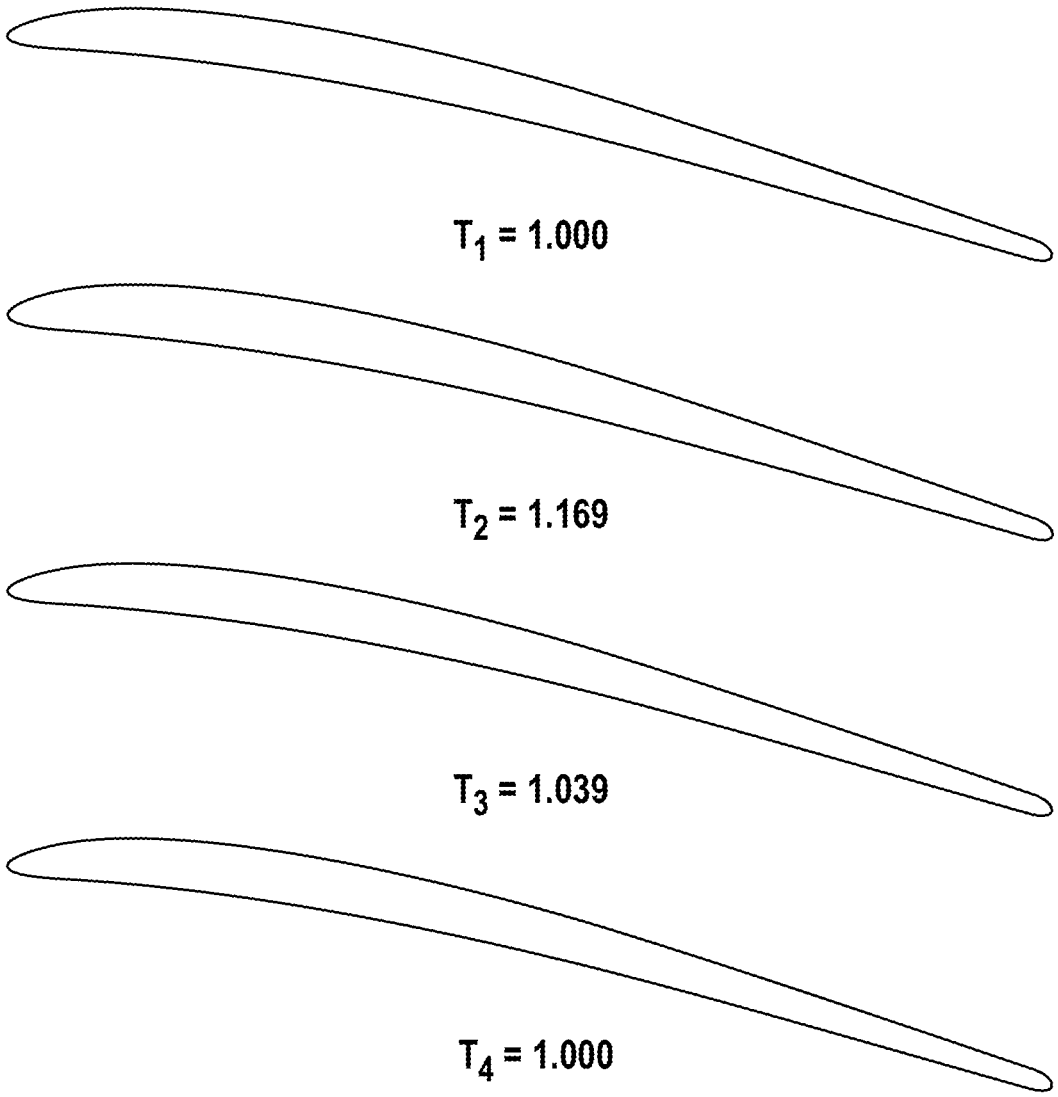
FIG. 6*d* shows representative cylindrical sections through the blades of the fan of FIG. 6*a*, showing one set of relative thicknesses that assure balance.

FIG. 6*d* shows cylindrical sections through each of the four blades of the fan of FIG. 6*a*, all at a radius equal to 0.8 times the radius of the blade tips. These sections show one set of thickness factors $T_i$ which result in a balanced fan. In this example $T_2$ has been chosen to be the value corresponding to the minimum thickness ratio as shown in FIG. 6*c*. As can be seen, this choice of $T_2$ results in $T_4$ being identically equal to $T_1$.

FIG. 6*b* shows a schematic of the spectrum of the fan shown in FIG. 6*a*, assuming that the single-blade spectrum is the same for all blades, and equal to that shown in FIG. 4*c*. The dotted bars represent the tones of the evenly-spaced 4-blade fan (FIG. 4*b*). Because the blades B1 to B4 of the fan shown in FIG. 6*a* do not form two identical groups of blades, the resulting fan spectrum has non-zero tones at all harmonics of shaft rate, and the subjective noise is likely to be improved when compared with that of the fan of FIG. 5*a*.

Figure 7A:
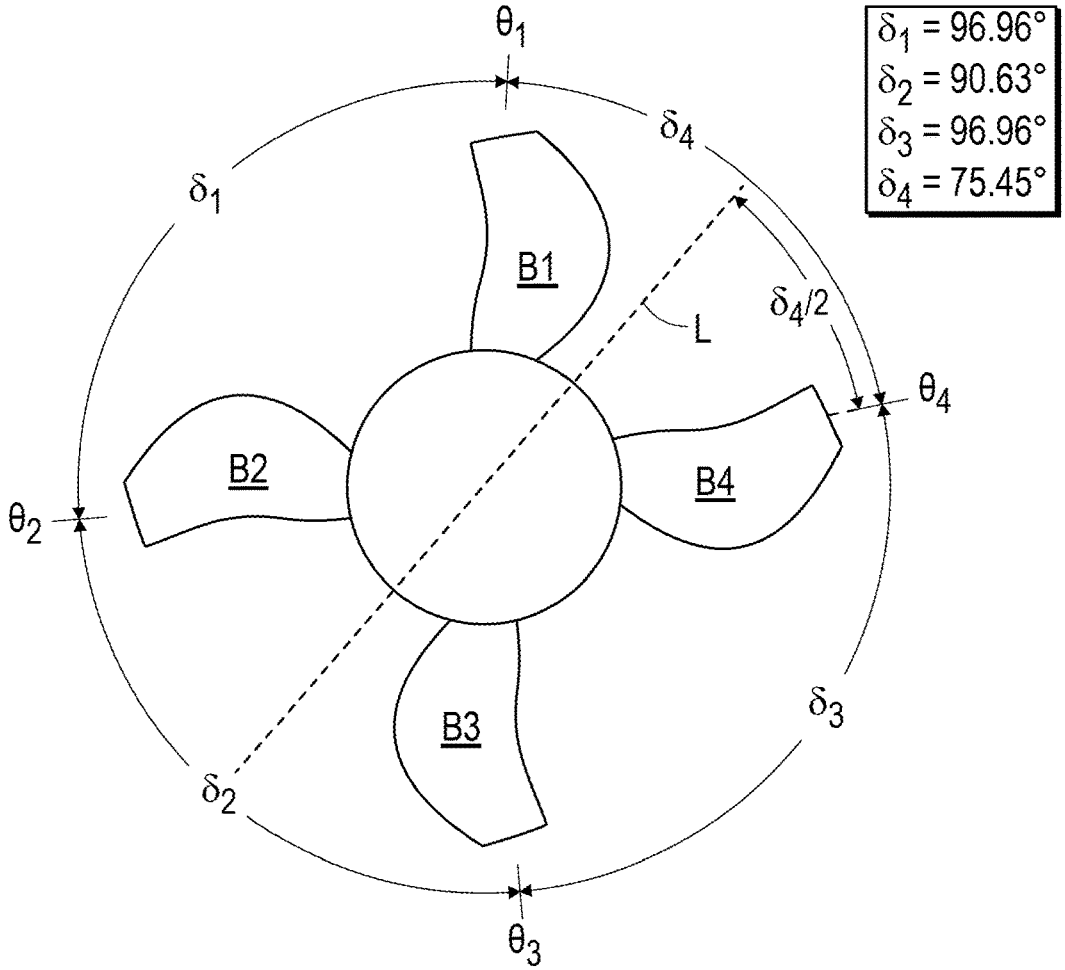
FIG. 7*a* is a schematic view of an unevenly-spaced 4-blade fan according to the present invention, where the blade spacing is symmetric about one axis.

FIG. 7*a* shows an unevenly spaced 4-blade fan according to the present invention where the blade spacing is symmetric. A symmetric blade spacing is defined as one where there exists a line of symmetry, shown in FIG. 7*a* as "L", such that the angular position of each blade relative to that line of symmetry is equal but of opposite sign to the angular position of another blade relative to that line of symmetry. Balance about the line of symmetry is achieved when the thickness factors are the same for each set of blades with symmetric positions—blades B1 and B4, and blades B2 and B3. Only one balance equation must be solved for the relative thickness factors of the two sets of blades. This fan can be made with only two different blade designs, a fact that may provide some measure of simplification in the manufacture of the fan. For example, this can reduce the number of required injection molds if blades are molded individually and then attached to a fan hub.

Figure 7B:
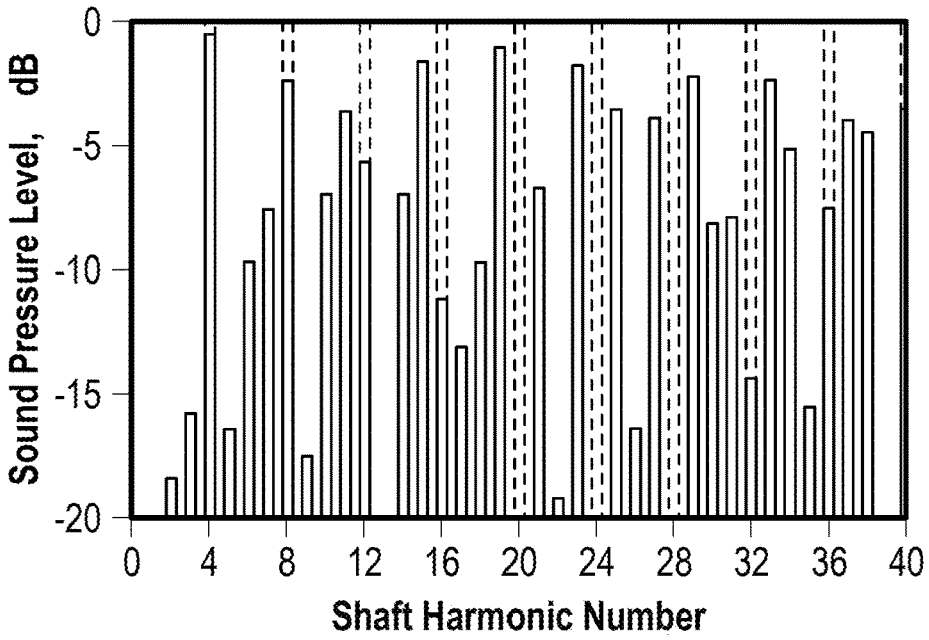
FIG. 7*b* is a schematic of the tone spectrum of the fan of FIG. 7*a*.
Figure 7C:
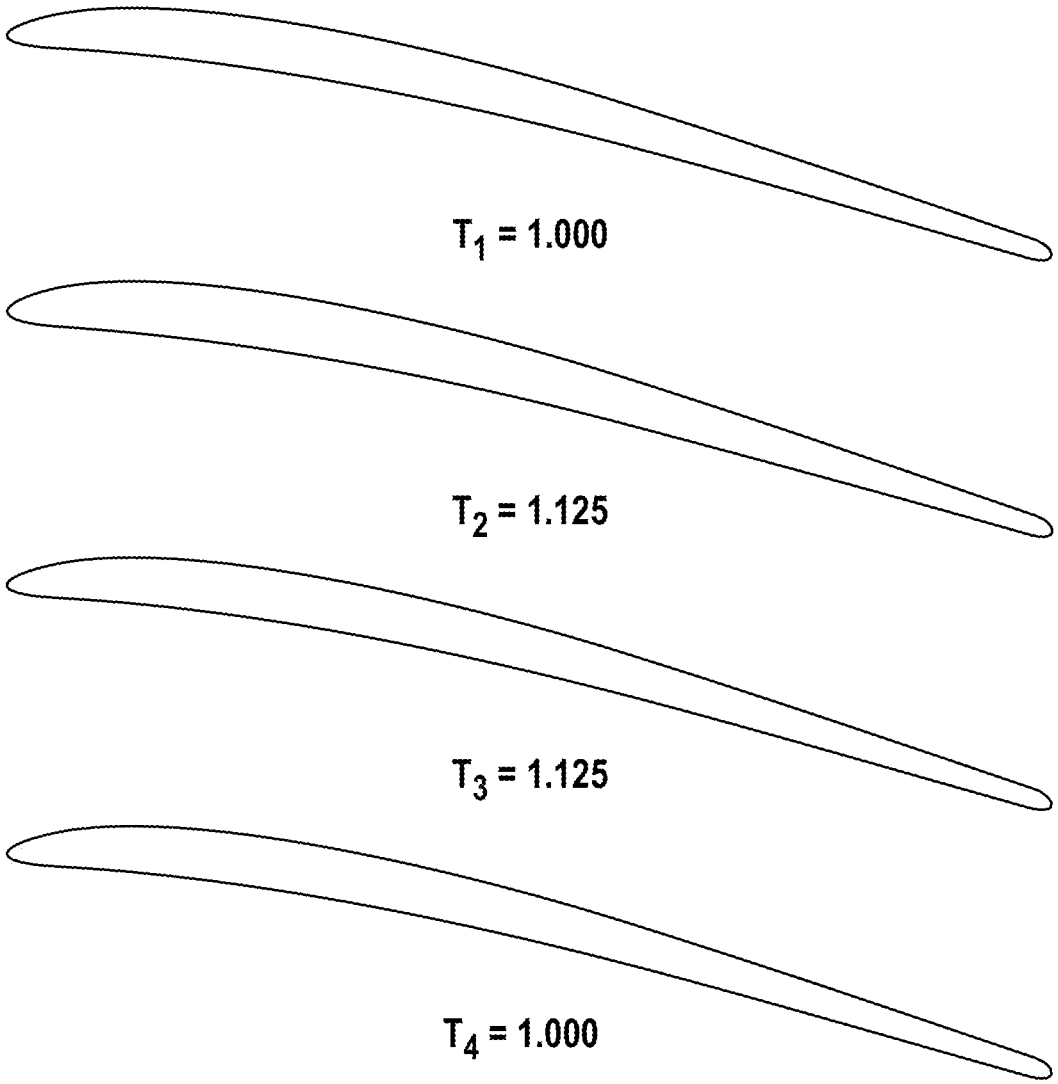
FIG. 7*c* shows representative cylindrical sections through the blades of the fan of FIG. 7*a*, showing the relative thicknesses that assure balance using only two thickness factors.

FIG. 7*c* shows cylindrical sections through each of the four blades of the fan of FIG. 7*a*, all at a radius equal to 0.8 times the radius of the blade tips. These sections show a set of thickness factors $T_i$ which results in a balanced fan. The thickness factors of blades B1 and B4, and of blades B2 and B3, are identical.

FIG. 7*b* shows a schematic of the tone spectrum of the fan shown in FIG. 7*a*, assuming that the single-blade spectrum is the same for all blades, and equal to that shown in FIG. 4*c*. The dotted bars represent the tones of the evenly-spaced 4-blade fan (FIG. 4*b*). By comparing the spectrum of FIG. 7*b* with the spectra of FIGS. 6*b* and 5*b*, it can be seen that the advantages of an unbalanced spacing are somewhat compromised by the choice of a symmetric arrangement of the blades, but there is still a significant advantage over a prior-art fan with a balanced spacing.

Figure 8A:
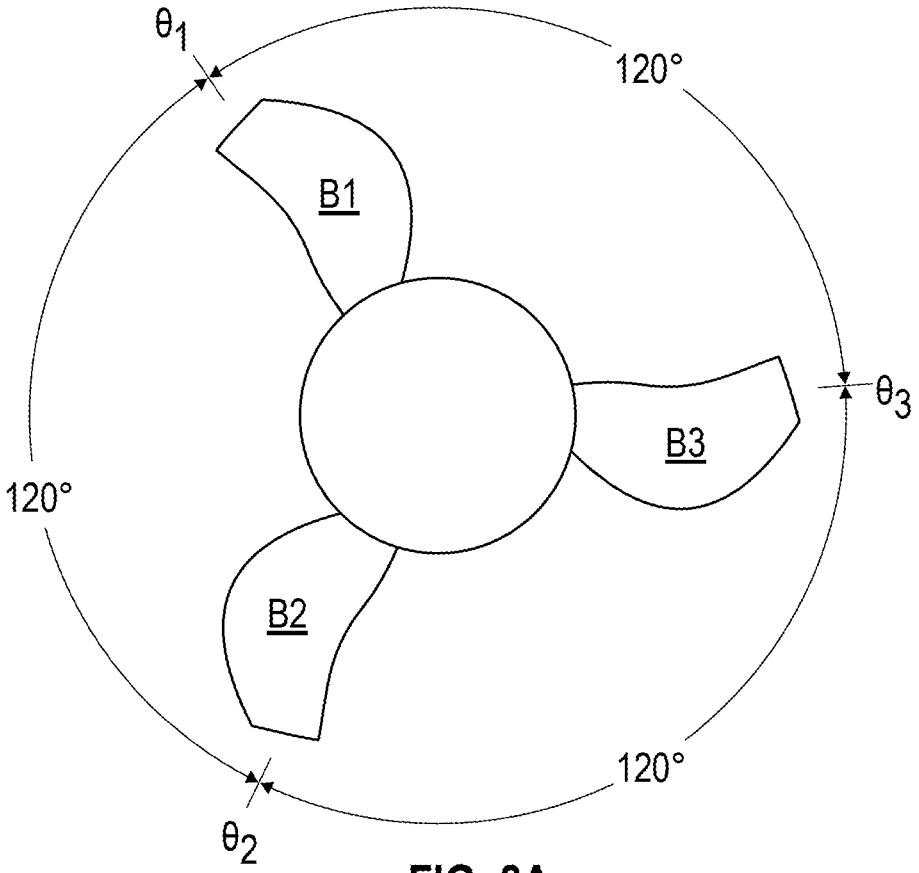
FIG. 8A (Prior Art)
FIG. 8*a* is a schematic view of a prior-art evenly-spaced 3-blade.
Figure 8B:
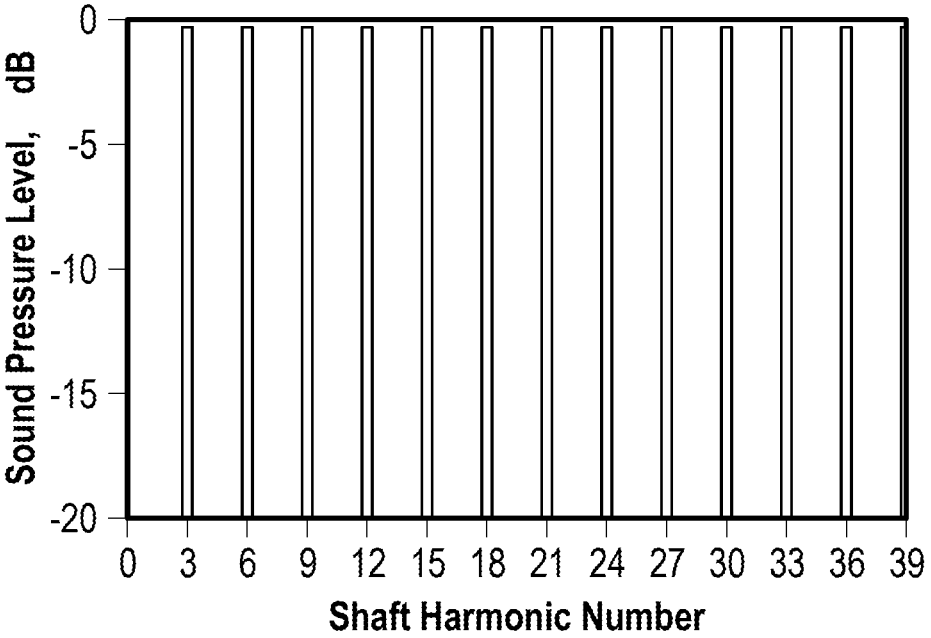
FIG. 8*b* is a schematic of the tone spectrum of the fan of FIG. 8*a*.
Figure 8C:
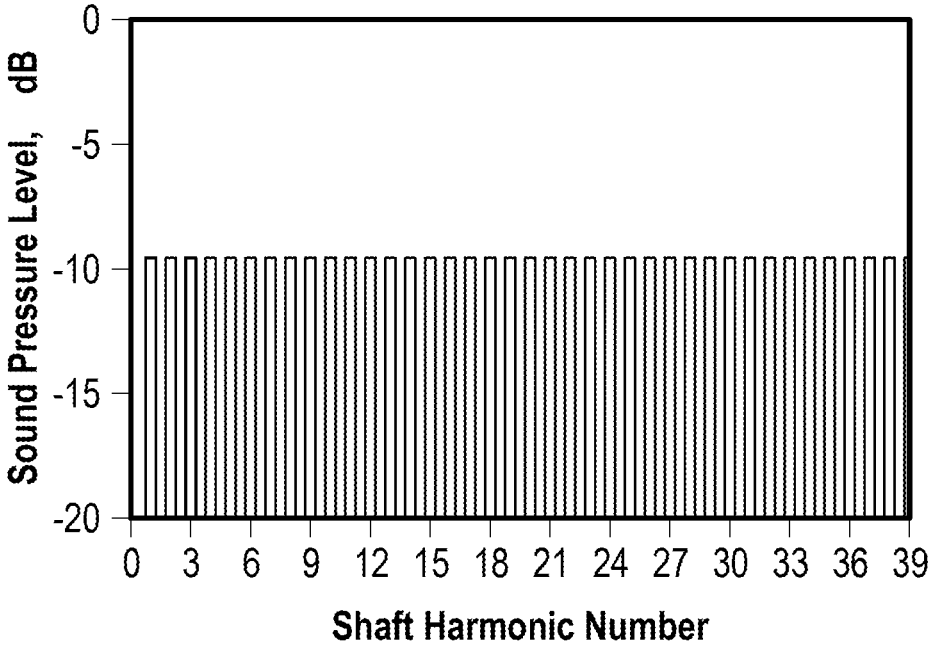
FIG. 8*c* is a schematic of the assumed single-blade tone spectrum that results in the fan tone spectrum of FIG. 8*b*.

FIG. 8*a* shows a prior-art 3-blade fan with evenly-spaced blades. The angular spacing between adjacent blades is a constant 120 degrees. FIG. 8*c* shows an impulsive single-blade spectrum which results in the fan spectrum of FIG. 8*b*. As in the case of a 4-blade or 5-blade fan with evenly-spaced blades, strong tones are at those shaft-rate harmonics which are harmonics of the blade rate, and there are no tones at other shaft-rate harmonics. The impulsive spectrum of FIG. 8*c* has been scaled so that the blade-rate tones of the fan spectrum have a magnitude of 0 dB.

If the blades of the fan shown in FIG. 8*a* have identical geometry, the fan will be in balance, but no other arrangement of three identical blades can satisfy the balance equation.

Figure 9A:
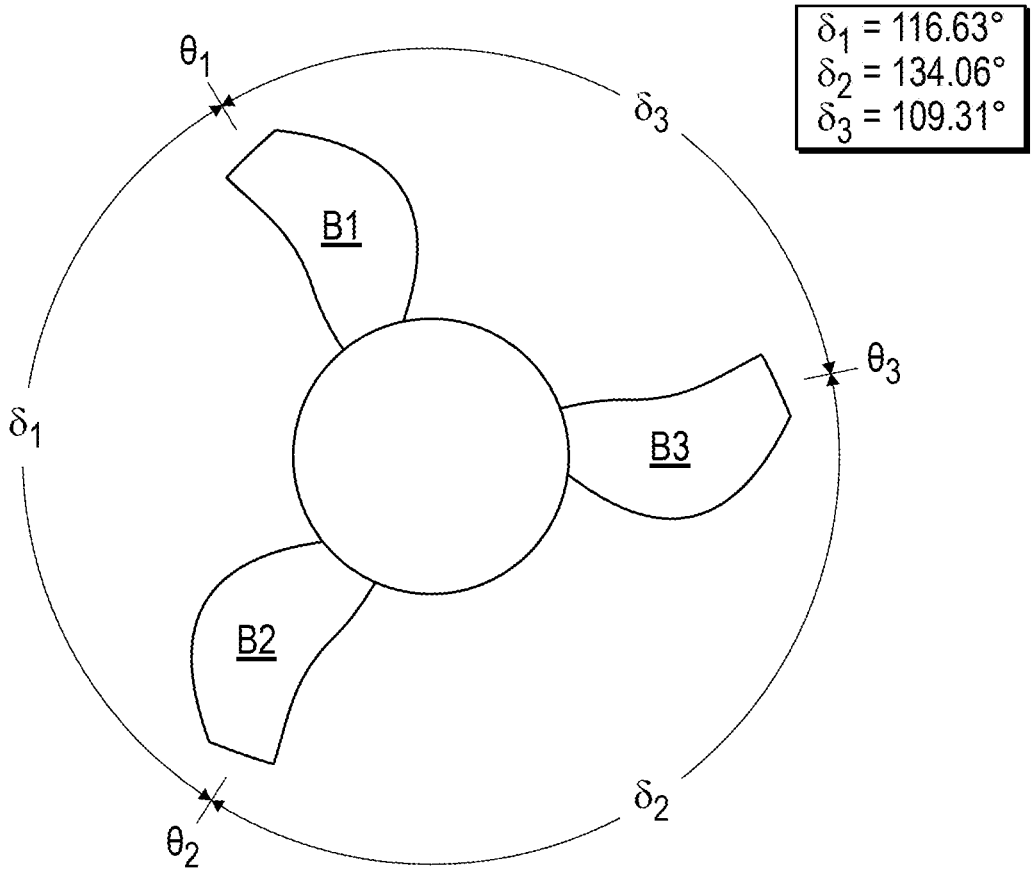
FIG. 9*a* is a schematic view of an unevenly-spaced 3-blade fan according to the present invention.

FIG. 9*a* shows an unevenly-spaced 3-blade fan according to the present invention. The blades of this fan, which are spaced to achieve the desired tonal properties, have identical geometry except for the blade thickness, which differs for each blade by a constant factor $T_i$. The values of $T_i$ which will result in a balanced fan are given by the solution of the equations governing the thickness factors of the fan in FIG. 6*a*. Since $T_1$ is identically equal to 1.0, the two balance equations can be solved for the unknown values $T_2$ and $T_3$.

Figure 9B:
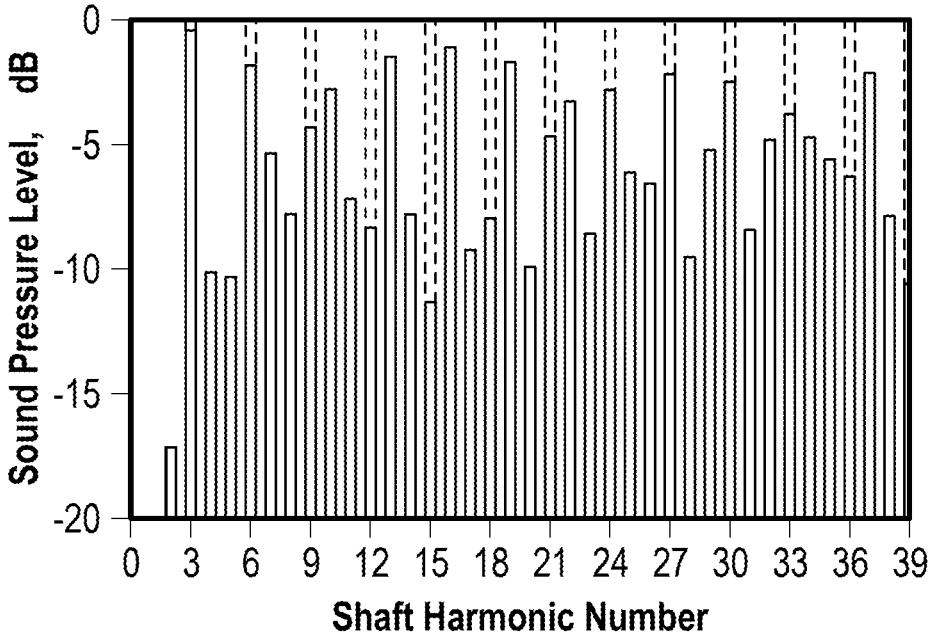
FIG. 9*b* is a schematic of the tone spectrum of the fan of FIG. 9*a*.
Figure 9C:
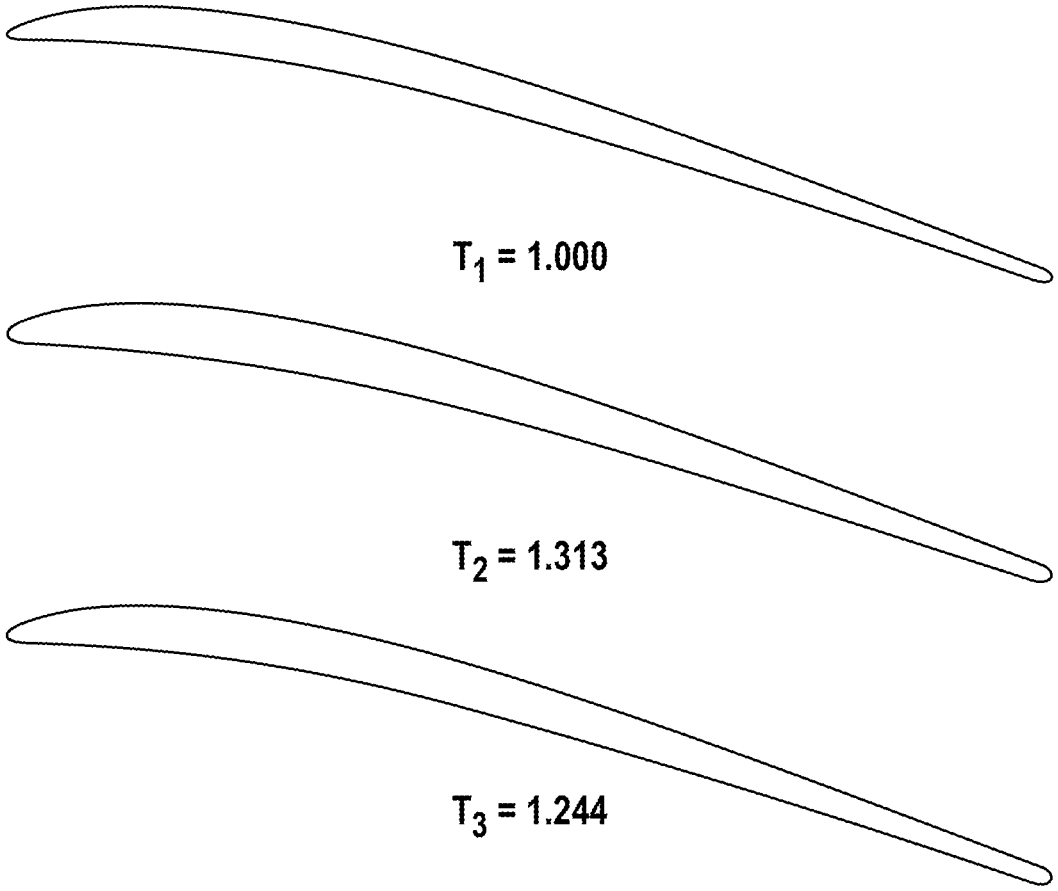
FIG. 9*c* shows representative cylindrical sections through the blades of the fan of FIG. 9*a*, showing the relative thicknesses that assure balance.

FIG. 9*c* shows cylindrical sections through each of the three blades of the fan of FIG. 9*a*, all at a radius equal to 0.8 times the radius of the blade tips. These sections show the thickness factors $T_i$ which result in a balanced fan.

FIG. 9*b* shows a schematic of the tone spectrum of the fan shown in FIG. 9*a*, assuming that the single-blade spectrum is the same for all blades, and equal to that shown in FIG. 8*c*. The dotted bars represent the tones of the evenly-spaced 3-blade fan (FIG. 8*b*).

Figure 10A:
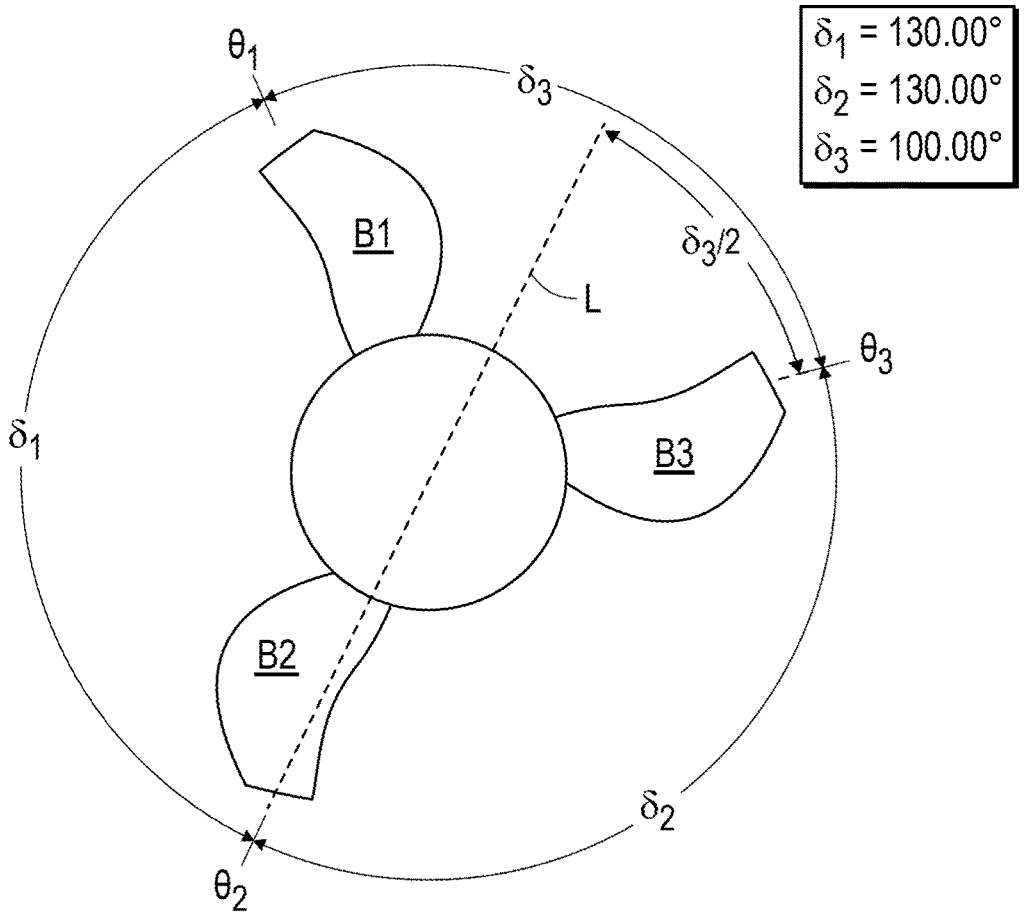
FIG. 10*a* is a schematic view of an unevenly-spaced 3-blade fan according to the present invention, where the blade spacing is symmetric about one axis.

FIG. 10*a* shows an unevenly spaced 3-blade fan according to the present invention where the blade spacing is symmetric. A fan with an odd number of blades and a symmetric blade spacing must have a line of symmetry with an angular position equal to that of one of the blades. In FIG. 10*a*, the line of symmetry has an angular position equal to that of blade B2. Balance about this line of symmetry is achieved when the thickness factor is the same for the two blades with symmetric positions—blades B1 and B3. Only one balance equation must be solved for the relative thickness factor of blade B2 compared with that of these two blades. This fan can be made with only two different blade designs, a fact that may provide some measure of simplification in the manufacture of the fan.

Figure 10B:
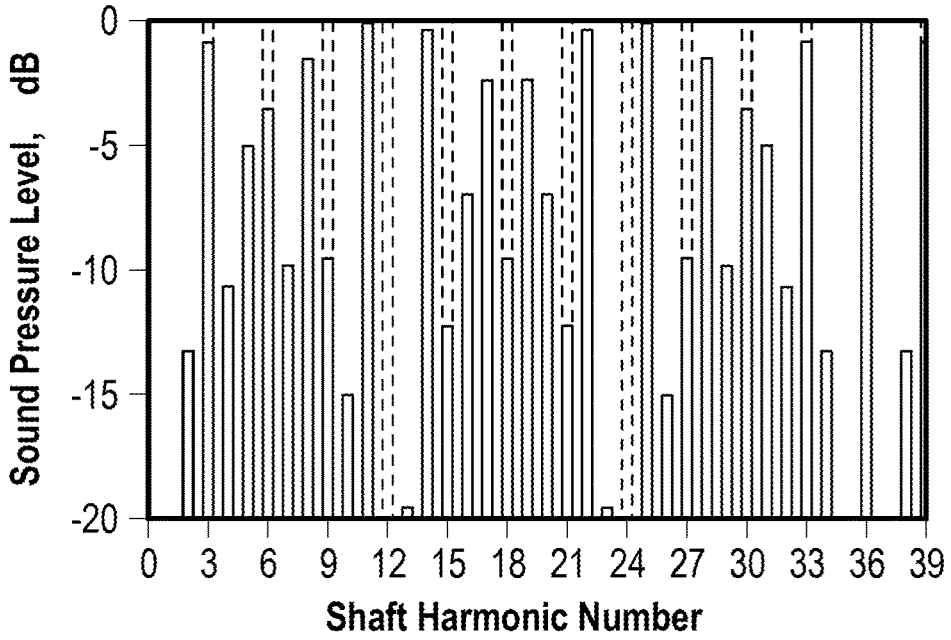
FIG. 10*b* is a schematic of the tone spectrum of the fan of FIG. 10*a*.
Figure 10C:
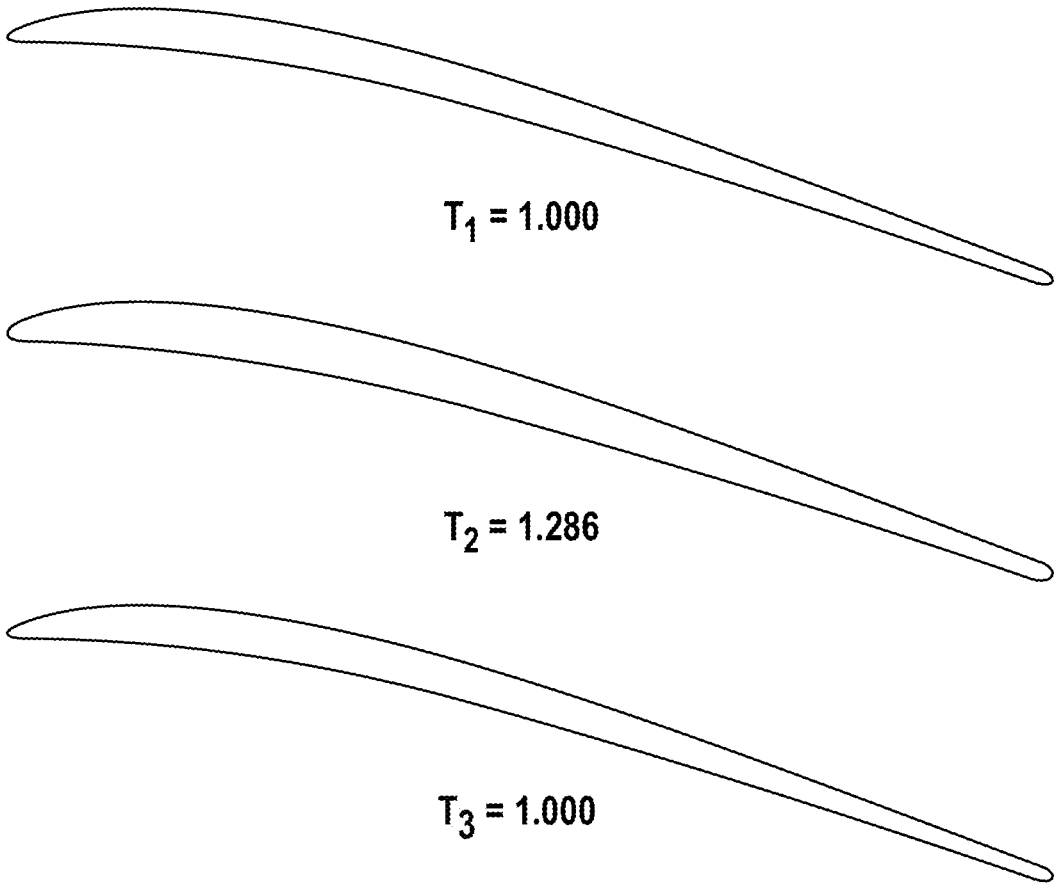
FIG. 10*c* shows representative cylindrical sections through the blades of the fan of FIG. 10*a*, showing the relative thicknesses that assure balance.

FIG. 10*c* shows cylindrical sections through each of the three blades of the fan of FIG. 10*a*, all at a radius equal to 0.8 times the radius of the blade tips. These sections show the thickness factors $T_i$ which result in a balanced fan. The thickness factors of blades B1 and B3 are identical.

FIG. 10*b* shows a schematic of the tone spectrum of the fan shown in FIG. 10*a*, assuming that the single-blade spectrum is the same for all blades, and equal to that shown in FIG. 8*c*. The dotted bars represent the tones of the evenly-spaced 3-blade fan (FIG. 8*b*). By comparing the spectrum of FIG. 10*b* with the spectra of FIGS. 9*b* and 8*b* it can be seen that the advantages of an unbalanced spacing are significantly compromised by the choice of a symmetric arrangement of the blades, but there is still a significant advantage over a prior-art fan with a balanced spacing.

Because the blades of each of the fans shown in FIGS. 6*a*, 7*a*, 9*a*, and 10*a* are identical except for thickness, and the static balance is assured through the satisfaction of the two balance equations, the couple imbalance will also be zero.

Although some spacing unevenness improves noise quality, increasing the unevenness does not necessarily improve the noise quality further. Although the perceived tonality of the fan noise can generally be further reduced by a more uneven spacing, at some point the perceived roughness of the sound can increase to a level that is objectionable. Other considerations, such as that of maintaining high aerodynamic efficiency, can also dictate that the extent of blade unevenness be limited. One metric of unevenness is the ratio of the largest inter-blade spacing "$\delta_{max}$" to the smallest inter-blade spacing "$\delta_{min}$". The fans shown in FIGS. 6*a*, 7*a*, 9*a*, and 10*a* have blade spacing ratios $\delta_{max}/\delta_{min}$ of 1.354, 1.285, 1.226, and 1.300. Some embodiments of the present invention may have greater spacing ratios, and some may have smaller spacing ratios. The spacing ratio is at least 1.15, and can be at least 1.20, in some constructions, while in some constructions the spacing ratio is less than or equal to 1.80, and can be less than or equal to 1.60.

The section plots of FIGS. 6*d*, 7*c*, 9*c*, and 10*c* show blades with a ratio of maximum thickness factor to minimum thickness factor of 1.169, 1.125, 1.313, and 1.286. Some embodiments of the present invention may have greater variation in blade thickness factor, and some may have less variation. The ratio of maximum thickness factor to minimum thickness factor is at least 1.05 in some constructions, and can be at least 1.10 in some constructions.

The fans shown are all free-tip fans. In other words, they do not feature a band connecting the blade tips. Free-tip fans have high efficiency at light loadings where a 3-blade or 4-blade fan can be a logical design choice, and are a good candidate for the present invention. But a banded fan could also feature an unbalanced blade spacing and achieve balance by the use of unequal blade thickness as described here.

In some locations the thickness distributions of the various blades may not be perfectly scaled. In particular, the fillets between the blades and the hub may not conform to the scaling. Similarly, if the blades feature the tip geometry described in U.S. Pat. No. 9,404,511, incorporated by reference herein, the thickness in the tip region may not be perfectly scaled. These and other minor deviations from perfect thickness scaling will not significantly affect the static and couple balance of the fan, and any remaining imbalance can be dealt with in a traditional manner. These fans will still exhibit the benefits of the present invention and are include in its scope.

Several embodiments of the present invention have been described, but the benefits of the present invention extend to other geometries and configurations, as well. It is the claims appended hereto, and all reasonable equivalents thereof, rather than the depicted embodiments, which define the true scope of the present invention. Fans having properties according to one or more aspects of the present invention can be forward-skewed, back-skewed, radial, or of a mixed-skew design. Similarly, fans according to one or more aspects of the present invention can have any mean surface geometry.

What is claimed is:

1. An axial fan comprising:

a hub; and a plurality of blades extending from a periphery of the hub, wherein each of the plurality of blades has a thickness which varies from a leading edge to a trailing edge and from a root to a tip, wherein the plurality of blades are unevenly spaced around the periphery of the hub in a pattern which is not balanced, and wherein the fan is balanced by variance in blade thickness among the plurality of blades, and the blade thickness of a first blade is scaled by individual blade thickness factors to define the thickness of each of the other blades, said blade thickness factors varying among the plurality of blades in such a way that the fan is balanced.

2. The axial fan of claim 1, wherein the blade thickness factors of all of the plurality of blades are unique.

3. The axial fan of claim 1, wherein the blade thickness factors of all but two of the plurality of blades are unique.

4. The axial fan of claim 1, wherein a ratio defined as the thickness factor of a thickest one of the plurality of blades divided by the thickness factor of a thinnest one of the plurality of blades is at least 1.05.

5. The axial fan of claim 1, wherein a ratio defined as the thickness factor of a thickest one of the plurality of blades divided by the thickness factor of a thinnest one of the plurality of blades is at least 1.10.

6. The axial fan of claim 1, wherein the plurality of blades consists of exactly three blades.

7. The axial fan of claim 1, wherein the plurality of blades consists of exactly four blades.

8. The axial fan of claim 1, wherein a mean surface of each of the plurality of blades is identical.

9. The axial fan of claim 1, wherein the axial fan is a free-tipped axial fan.

10. The axial fan of claim 1, wherein the axial fan is an automotive engine-cooling fan.

11. The axial fan of claim 1, wherein the spacing of the plurality of blades is symmetric about a line of symmetry.

12. The axial fan of claim 11, wherein two of the plurality of blades whose positions are symmetric relative to the line of symmetry have equal thicknesses.

13. The axial fan of claim 1, wherein a ratio defined as a largest spacing angle between adjacent ones of the plurality of blades divided by a smallest spacing angle between adjacent ones of the plurality of blades is at least 1.15.

14. The axial fan of claim 1, wherein a ratio defined as a largest spacing angle between adjacent ones of the plurality of blades divided by a smallest spacing angle between adjacent ones of the plurality of blades is at least 1.20.

15. The axial fan of claim 1, wherein a ratio defined as a largest spacing angle between adjacent ones of the plurality of blades divided by a smallest spacing angle between adjacent ones of the plurality of blades is less than or equal to 1.80.

16. The axial fan of claim 1, wherein a ratio defined as a largest spacing angle between adjacent ones of the plurality of blades divided by a smallest spacing angle between adjacent ones of the plurality of blades is less than or equal to 1.60.

17. An axial fan comprising:

a hub; and a plurality of blades extending from a periphery of the hub, wherein each of the plurality of blades has a thickness which varies from a leading edge to a trailing edge and from a root to a tip, wherein the plurality of blades are unevenly spaced around the periphery of the hub in a pattern which is not balanced, wherein the fan is balanced by variance in blade thickness among the plurality of blades, and wherein the spacing of the plurality of blades is symmetric about a line of symmetry, and two of the plurality of blades whose positions are symmetric relative to the line of symmetry have equal thicknesses.

* * * * *